US005448933A

United States Patent [19]

Grabbee

[11] Patent Number: 5,448,933

[45] Date of Patent: Sep. 12, 1995

[54] STAMPING MACHINE STRIPPER AND DIE SET

[75] Inventor: Dimitry G. Grabbee, Middletown, Pa.

[73] Assignee: The Whitaker Corporation, Wilmington, Del.

[21] Appl. No.: 204,032

[22] Filed: Mar. 1, 1994

[51] Int. Cl.[6] ..... B26D 7/18

[52] U.S. Cl. ..... 83/24; 83/25; 83/98; 83/216; 83/554

[58] Field of Search ..... 83/24, 98, 554, 216, 83/217, 39, 103, 25

[56] References Cited

U.S. PATENT DOCUMENTS

| | | | |
|---|---|---|---|
| 2,341,187 | 2/1944 | Menger et al. | 83/98 |
| 2,494,413 | 1/1950 | Slettengren | 74/38 |
| 3,426,635 | 2/1969 | Nicklasson | 83/530 |
| 3,682,029 | 8/1972 | Hass et al. | 83/69 |
| 3,700,150 | 10/1972 | Cheney | 83/13 |
| 4,526,076 | 7/1985 | Hogan | 83/554 |
| 4,628,780 | 12/1986 | Hicks | 83/98 |
| 4,653,365 | 3/1987 | Takasaki et al. | 83/103 |
| 4,977,804 | 12/1990 | Naito | 83/98 |
| 5,042,336 | 8/1991 | Capps | 83/13 |
| 5,111,723 | 5/1992 | Andrush et al. | 83/98 |
| 5,136,907 | 8/1992 | Bakermans et al. | 83/93 |
| 6,682,029 | 8/1972 | Hass et al. | 83/69 |

*Primary Examiner*—Kenneth E. Peterson
*Attorney, Agent, or Firm*—Bruce J. Wolstoncraft

[57] ABSTRACT

A method and apparatus for stamping a strip of material to prevent slug "back out" is disclosed. The stamping machine has a punch which moves through a first stroke and a second stroke. A slug receiving opening is provided in the die. The punch is moved during the first stroke into engagement with the strip of material. A slug is punched from the strip of material to form an opening therein. The punch is then moved through a second stroke, in which the punch is moved through the opening in the strip of material. As this occurs, the punch forces a volume of gas ahead of the punch, so that the volume of gas cooperates with the slug to force the slug into the slug receiving opening.

18 Claims, 5 Drawing Sheets

STAMPING MACHINE STRIPPER AND DIE SET

FIELD OF THE INVENTION

This invention relates generally to stamping tools and machines. In particular, the invention is directed to an apparatus which prevents the punched slug from backing up into the material strip as the punch withdraws from the strip.

BACKGROUND OF THE INVENTION

In general, simple punching operations involve placing a sheet of material between a die and punch set. When a force is exerted on the punch which is large enough to drive the punch through the material and into the die, a slug of material is sheered out of the material that corresponds to the shape of the punch and the die. In commercial operations a press machine will be used to drive the punch in a downstroke/upstroke motion in order to move the punch into and out of the material (usually a large sheet or rolled strip).

In a particular stamping operation, a floating stripper can be used. In these applications the floating stripper will descend onto the material first and hold the material in place, deriving the pressure required from compression springs in the die. With the material securely held in position, the punch descends and at some point, the face of the punch will impinge on the oil film provided on surface of the material, if such is present, or on the material itself. The punch will continue to exert pressure normal to the surface, until the metal yields and shears out.

The rate of descent of the punch is controlled by the kinematics of the press, until such time when the punch comes in contact with the strip or oil film. As this occurs, the punch will exhibit some buckling property, particularly if the punch is of a slender configuration. Such buckling is limited by the amount of space between the punch, the stripper plate or any other guiding mechanisms, such as for example, interlocking split bushings, which are commercially available. While such buckling occurs, the ram of the press and the die set continue the downward motion according to its kinematics. The movement of the punch is retarded due to buckling and like a spring, stores energy. When the strength of the material is finally exceeded and the material is sheared out, the slug or the part of the metal directly in front of the punch will shear and fracture out of the strip and move downward through the opening in the die. When this has occurred, the stored energy in the punch is released and the punch is almost instantly reverted to its original full length. The energy released by this sudden acceleration of the mass of the punch may be so high as to exceed the strength of the punch's head and tensile fracture occurs at the transition of the punch body to the punch head. This is a common problem, particularly when punching holes in difficult materials, such as printed circuit fiberglass panels. Having a punch made of massive cross section with only the tip of the correct dimensions is not always possible because of the required proximity of adjacent holes.

The forces between the face of the punch and the surface of the metal can be extremely high. In the absence of lubricants, one will frequently observe the transfer of the image or surface finish of the punch onto the strips, which means that the elastic limit of the material locally has been substantially exceeded. If a lubricant is used, and particularly at higher punch speeds, such oils do not have sufficient time to escape laterally, i.e. its displacement time constant has been exceeded, and the image transfer will not occur. In such cases, the effective fit between the surface of the metal and the face of the punch is such that if the punch is suddenly retracted, a vacuum will exist between the face of the punch and the slug, and if the friction of the slug against the die is low, the slug may follow the punch during its retraction, in effect creating a condition generally referred to as "slug back out". This is an unwanted result, since the slug now is trapped in the tool, which causes damage to the parts being punched and may lead to breakage of the tools.

When fracturing of the metal during punching occurs, there is a byproduct of extremely small particles which accumulate in the oil. These are readily observable by their coloring of the residual oil, according to their substance. In some cases, these particles are trapped between the stripper plate and the strip, and if the pressure is sufficient, mar the surface of the strip which then requires a correction measure such as continuous flushing by a lubricant in the die.

SUMMARY OF THE INVENTION

The present invention is directed to an improved apparatus and method for stamping which prevents the condition of "slug back out". In the present invention, the punch descends onto the strip, expelling air or oil or partially displacing oil, thus creating a vacuum condition at the interface. The movement of the punch continues as described above, thereby removing the slug from the material. However, as the punch is retracted, the vacuum formed between the punch and the slug will cause the slug to also retract. According to the present invention, the punch is retracted to just above the surface of the material and is then forced to redesend through the material and into the die plate. As the punch is retracted, the friction between the slug and the material from which it was cut is quite high. This friction is sufficient to break the vacuum between the slug and the punch. Thus, the slug is partially reinserted into the strip. As the punch descends the second time, a cushion of gas will be provided between the punch and the slug, thereby preventing the formation of a vacuum therebetween. As the vacuum is not created, the second retraction of the punch will not cause the slug to reenter the material, thus eliminating the problem of "slug back out".

BRIEF DESCRIPTION OF THE DRAWINGS

The present invention will now be described by way of example with reference to the accompanied drawings in which.

DETAILED DESCRIPTION OF THE INVENTION

Figure 1:
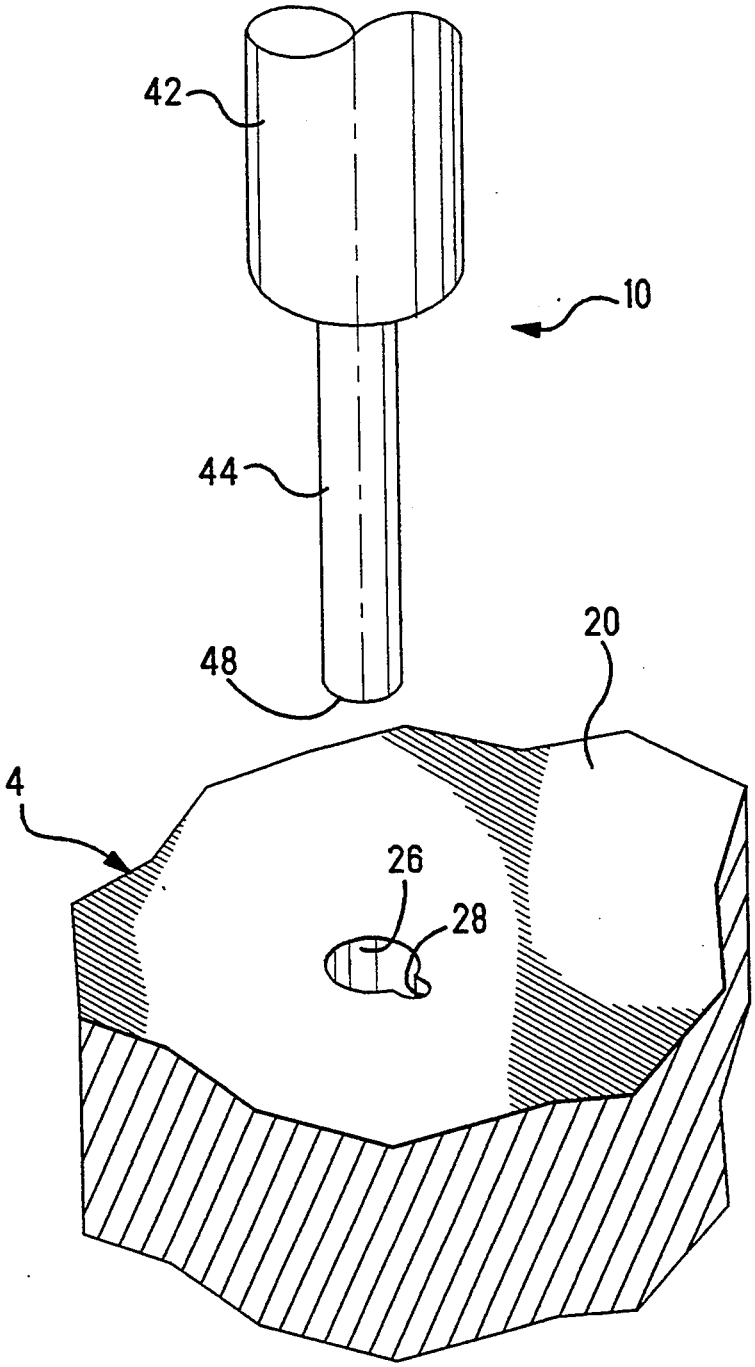
FIG. 1 is a perspective view of a punch and a stripper plate of a punch apparatus of the present invention with the punch removed therefrom.

The punch assembly 1 of the present invention, as shown in FIGS. 1–7, has a punch backer 2, a stripper plate 4, a die plate 6, a punch holder 8, and a punch 10. As best shown in FIGS. 2 through 7 the punch assembly 1 is used to stamp openings or the like in material 12. The material can be in the form of a thin rolled sheet of metal or any other similar material.

Figure 3B:
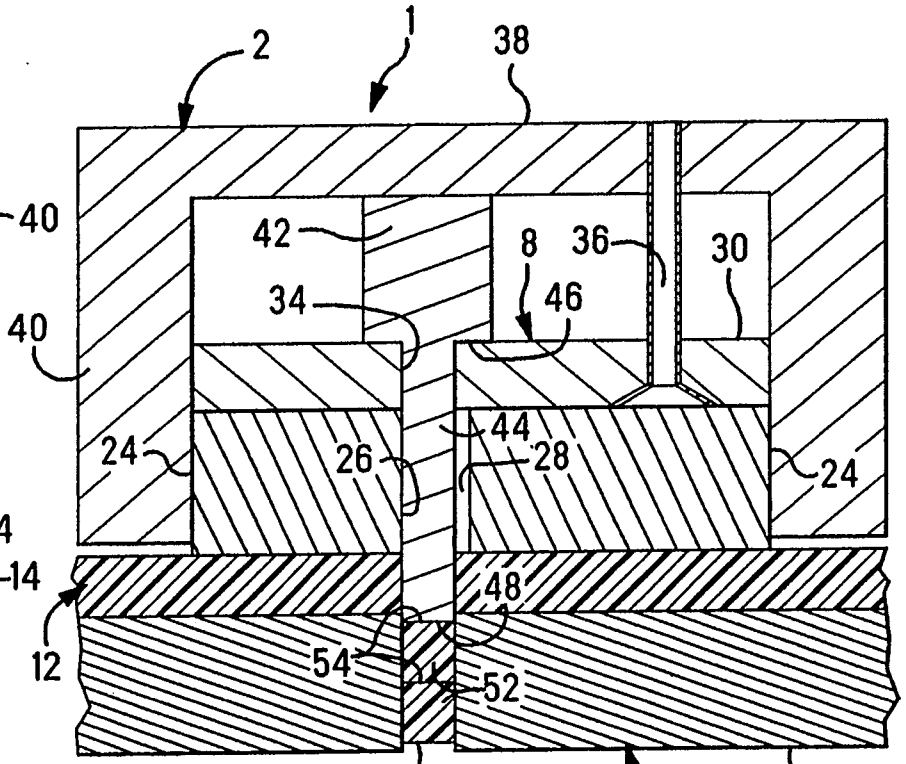
FIG. 3 is a cross sectional view of the punch apparatus after making the first strike on the material, showing the slug pushed out into an opening of a die.
Figure 6:
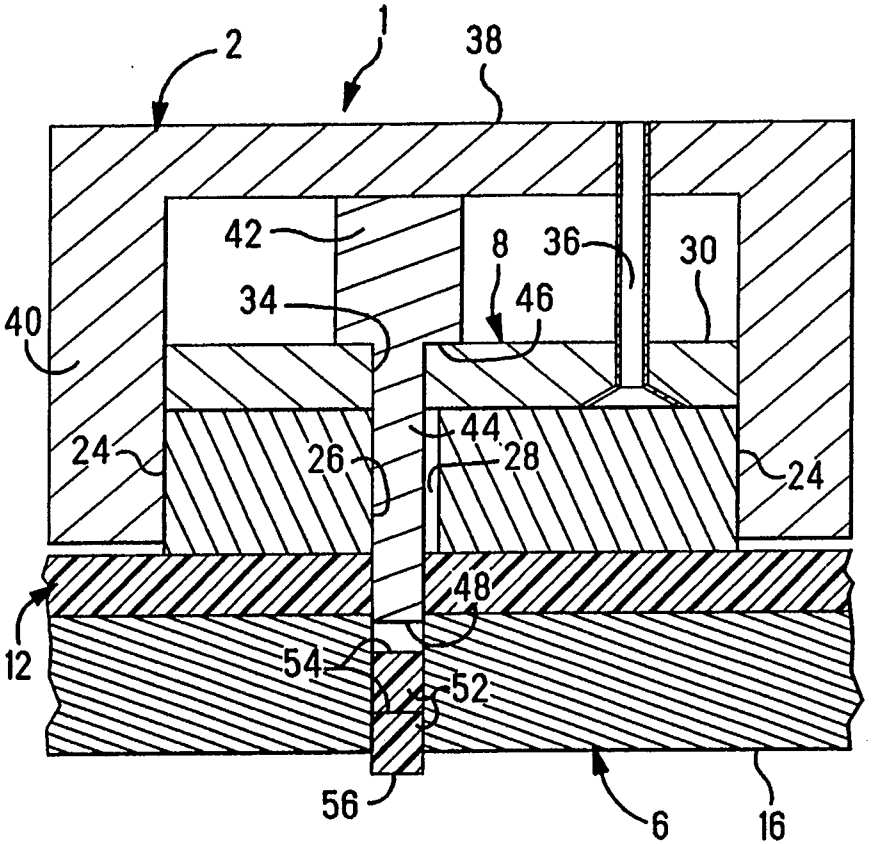
FIG. 6 is a cross sectional view of the punch apparatus after the punch has made the second strike, showing the slug pushed out of the material.

The die plate 6 has an upper surface 14 and a lower surface 16. A slug receiving opening 18 extends between the upper surface 14 and lower surface 16. The slug receiving opening 18 is dimensioned to receive the slugs of the material therein as is shown in FIG. 3 and is also dimensioned to receive a portion of the die therein as best shown in FIG. 6. The diameter of the slug receiving opening 18 is dimensioned to be slightly larger than the diameter of the lower section of the punch 10. This allows the punch to enter the opening. However, the diameter of the opening must be proximate to the diameter of the punch, so that the punch will be "captured" by the opening, thereby preventing excessive wear of the punch.

The stripper plate 4 has an upper surface 20 and an oppositely facing lower surface 22. End walls 24 extend between the upper and lower surfaces and are essentially perpendicular thereto. A punch receiving opening 26 is provided on the stripper plate 4 and extends between the upper surface 20 and the lower surface 22. The opening 26 has a channel 28 provided adjacent thereto. The opening has a larger diameter than the channel 28.

The punch holder 8 has an upper surface 30 and a lower oppositely facing surface 32. A punch receiving opening 34 is provided in the punch holder 8 and extends from the upper surface to the lower surface. A passageway 36 is also provided on the punch holder 8. The passageway extends from the lower surface toward the upper surface. In the configuration shown, the passageway has a funnel type shape proximate the lower surface. The passageway continues beyond the upper surface 30 in the form of a tube or other similar member.

The punch backer 2 has a top wall 38 and sidewalls 40 extending therefrom. The sidewalls are essentially perpendicular to the longitudinal axis of the top wall 38. The passageway 36 extends through the top wall 38. The sidewalls 40 are spaced apart a distance which is essentially equal to the width of the stripper plate 4. The dimensioning allows the stripper plate to be captured between the sidewalls 40 of the punch backer 2.

The punch 10 has an upper section 42 and a lower section 44. As is shown in the drawings, the upper section 42 has a larger cross-sectional area then the lower section 44. Shoulders 46 are provided as the transition between the upper section 42 and the lower section 44. The shoulders 46 cooperate with the upper surface 30 of the punch holder 8 as the assembly 1 is moved. The lower section 44 of the punch 10 has a bottom surface 48 which cooperates with the material 12.

As shown in FIGS. 2, 4, 5, and 7 an air plenum 50 is provided between the stripper plate 4 and punch holder 8. As shown in FIGS. 3 and 6, the air plenum is configured to expand or contract to allow the stripper plate 4 and punch holder 8 to be moved into engagement or out of engagement with each other, as will be more fully described below.

A plurality of slugs 52 are provided from material 12 as the stamping operation occurs. Each slug 52 has an upper surface 54 and a lower surface 56.

In operation the material 12 is inserted between the die plate 6 and the stripper plate 4. Once the material is fed into position, gas is pumped through the passageway 36 into the air or gas plenum 50. The gas can be air or other inert gas which has a sufficient density. The insertion of the gas into the air plenum 50 continues until the density of the gas is sufficient to apply a downward force, as viewed in FIG. 2, to the stripper plate 4. This downward force ensures that the stripper plate 4 will cooperate with the material 12 to maintain the material in the proper position. By utilizing the force of the gas, a separate resilient mechanism is not required.

With the material 12 adequately maintained in position, the punch backer 2 and the punch 10 are moved downwardly to the position shown in FIG. 3. As this occurs, the air plenum 50 is reduced in area from that shown in FIG. 2 to the area shown in FIG. 3. As the area is reduced, the gas is allowed to flow backward through the passageway 36. The passageway 36 is dimensioned to allow a controlled escape of the gas from the air plenum 50, such that as the gas escapes, a sufficient pressure is continuously provided in the air plenum to ensure that the stripper plate 4 is maintained in position on the material 12. In the position shown in FIG. 3, the volume of the air plenum 50 is reduced to essentially zero, and the punch holder 8 cooperates directly with the stripper plate 4 to maintain the stripper plate in position.

Figure 2:
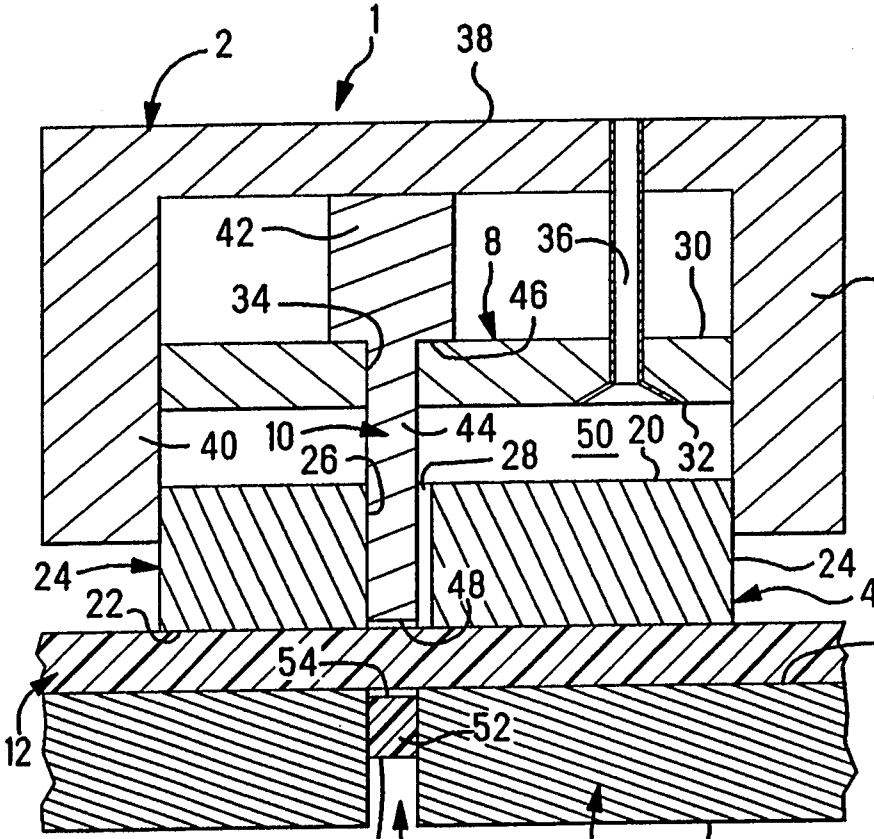
FIG. 2 is a cross sectional view of the punch apparatus prior to making the first strike or hit on the material.

As the punch backer 2 and the punch 10 are moved from the position shown in FIG. 2 to the position shown in FIG. 3, the bottom surface 48 of the lower section 44 of the punch cooperates with the material 12 to punch the slug 52 from the material 12. The cooperation of the punch 10 with the material 12 occurs in the normal manner known to those skilled in the art. This movement of the punch 10 to the position shown in FIG. 3 causes the slug 52 to be moved from the material 12 into the slug receiving opening 18 of the die plate 6.

It is worth noting that the diameter of the punch receiving opening 34 is slightly larger than the diameter of the slug 52 and also slightly larger than the diameter of the lower section 44 of the punch 10. The dimensioning of the diameters is to facilitate the movement of the slugs into the opening. The diameter of the slug receiving opening 18 cannot be significantly larger than the diameter of the lower section 44 of the punch 10, as this would provide unsuitable wear on the punch 10.

Figure 4:
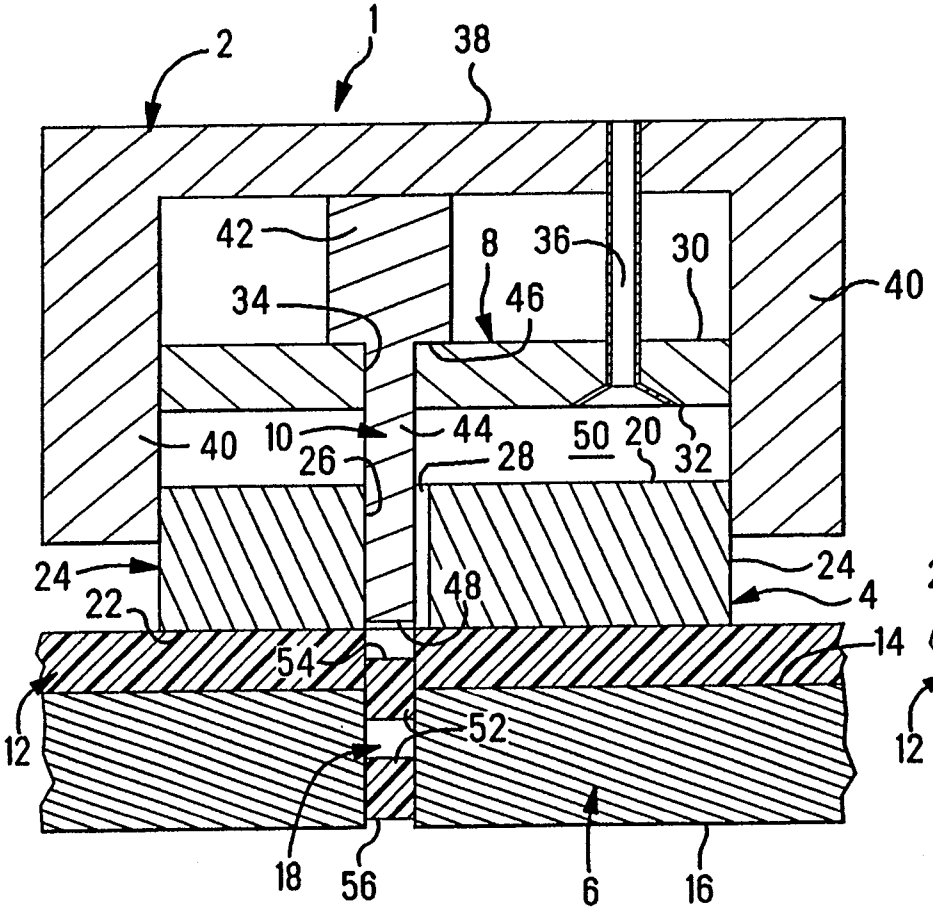
FIG. 4 is a cross sectional view of the punch apparatus showing the punch retracted from the material and showing the slug drawn back into the material.

After the assembly 2 has been moved to the position shown in FIG. 3, the punch 10 is retracted to the position shown in FIG. 4. As the punch 10 is retracted the punch backer 2 and the punch holder 8 are also retracted to the position shown in FIG. 4. As this occurs, gas reenters the air plenum 50, thereby providing the force required to hold the stripper plate 4 in position.

As the punch 10 is retracted the bottom surface 48 cooperates with the slug 52 to move the slug from the slug receiving opening 18 back into the material 12. This is due to the vacuum created between the slug 52 and the bottom surface 48.

As the punch descends onto the strip of material, the punch expels the air and/or oil which is positioned on the strip, and thus creates a vacuum condition at the interface between the bottom surface of the punch and the material. This vacuum remains in effect, and consequently, as the punch is retracted, the vacuum between the punch and the slug will cause the slug to also retract. As the slug receiving opening 18 is dimensioned to be slightly larger than the diameter of the slug 52, the friction provided between the wall of the slug receiving opening and the sheared surfaces of the slug will not be sufficient to break the vacuum. Consequently, the slug will be retracted back into the opening of the material 12.

As the retraction of the punch 10 continues, the sheared edges of the slug 52 will engage the sheared edges of the opening provided in the material 12. The engagement of these two sheared surfaces will cause friction to be generated. The friction provided between the sheared surfaces is of a sufficient magnitude to overcome the vacuum provided between the slug and the punch. Therefore, when the slug 52 reaches the position shown in FIG. 4, the friction between the sheared surfaces causes the vacuum between the slug 52 and the bottom surface 48 of the punch 10 to be broken. As a result, the punch 10 continues to retract without influencing the slug 52. Consequently, the punch 10 is retracted to its initial position and the slug 52 is maintained in the intermediate position, as is represented by FIG. 4.

Maintaining the slug 52 in the intermediate position shown in FIG. 4 is unacceptable. In this position, the slug will either wedge in the opening and prevent the movement of the material or will be displaced from the opening and lodge somewhere in the stamping machine, thereby causing unnecessary damage and wear to the machine.

With the punch 10 provided in the position shown in FIG. 4, the gas provided in the air plenum 50 is allowed to flow through the channel 28 into the opening provided between the slug 52 and the bottom surface 48 of the punch 10.

Figure 5:
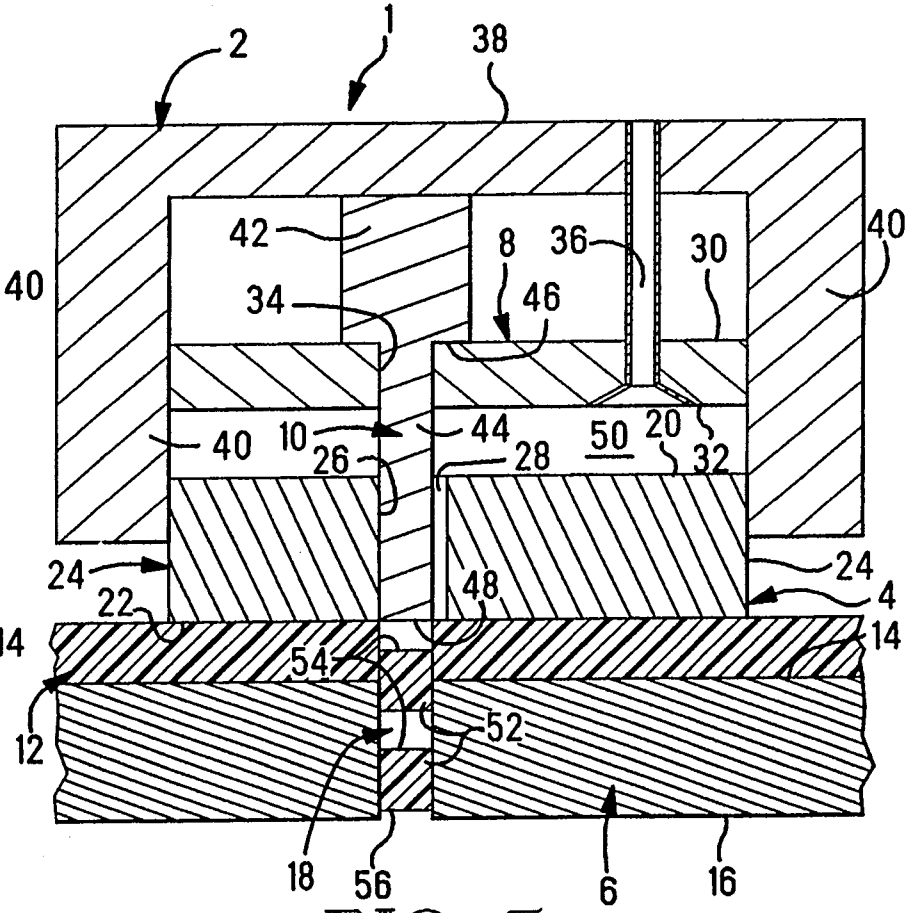
FIG. 5 is a cross sectional view of the punch apparatus showing the punch moved downward for a second time.

In order to move the slug 52 from the intermediate position shown in FIG. 4, the punch 10 is again moved downward. This sequence is shown in FIGS. 5 and 6. As the punch 10 is moved downward, the bottom surface 48 moves beyond channel 28, as is shown in FIG. 5. In this position the gas provided between the bottom surface 48 and slug 52 cannot escape through channel 28 and is therefore trapped in position. As the downward motion of the punch 10 continues, the gas compresses slightly. The compression of the gas varies according to its density.

As the downward motion of the punch 10 continues, the bottom surface 48 of the punch forces the trapped gas downward. As the trapped gas is forced downward, the trapped gas cooperates with the slug 52, to move the slug 52 downward, thereby preventing a vacuum from being formed between the bottom surface and the slug, as was previously discussed.

The downward motion of the punch 10 continues until the bottom surface 48 is moved beyond the material 10 and into the slug receiving opening 18, as is shown in FIG. 6. In this position, the slug 52 is moved well beyond the material 10 into the slug receiving opening 18.

Figure 7:
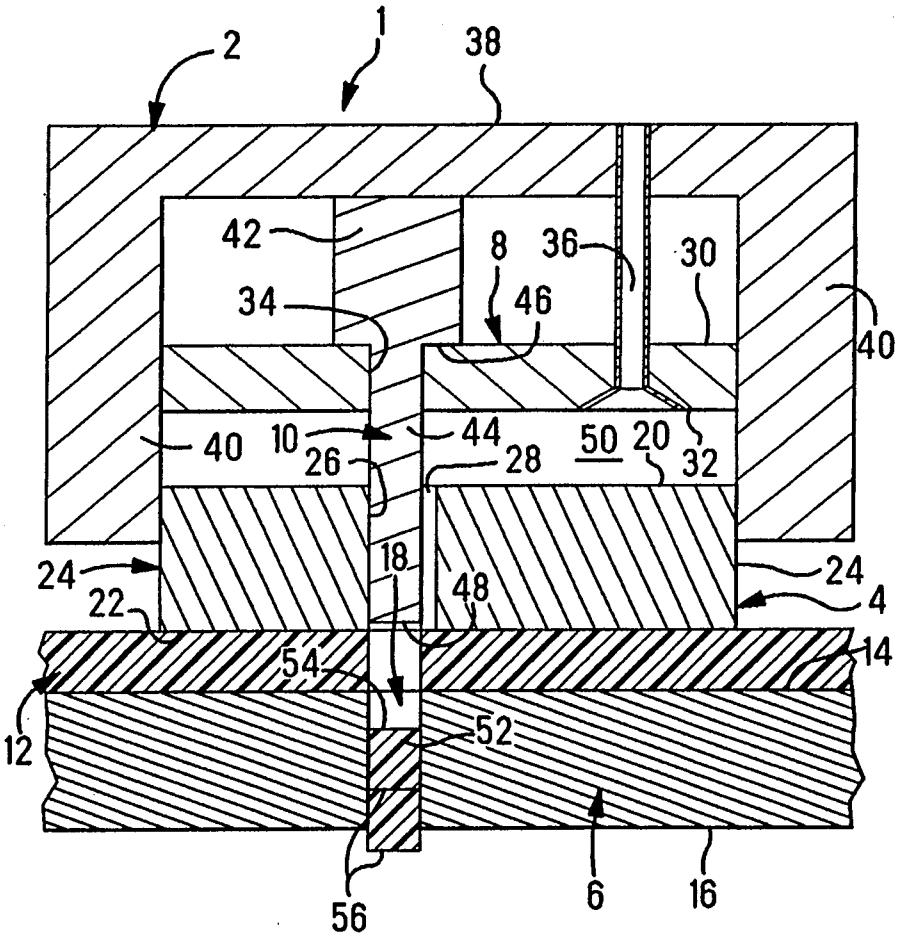
FIG. 7 is a cross sectional view of the punch apparatus after the punch has been retracted from the material after the second strike, the slug is positioned in the opening of the die.

The punch is then retracted from the position shown in FIG. 6 to the position shown in FIG. 7. As the punch 10 is retracted, the slug 52 remains in position in the slug receiving opening 18. The lack of movement of slug 52 as the punch is retracted for the second time is due to the presence of the trapped gas provided between the bottom surface 48 of the punch and the slug 52 and the lack of a vacuum formed therebetween. Consequently, as the punch 10 is retracted for a second time there is no suction provided between the punch and the slug and therefore the slug is maintained in the position in the slug receiving opening 18.

Figure 8:
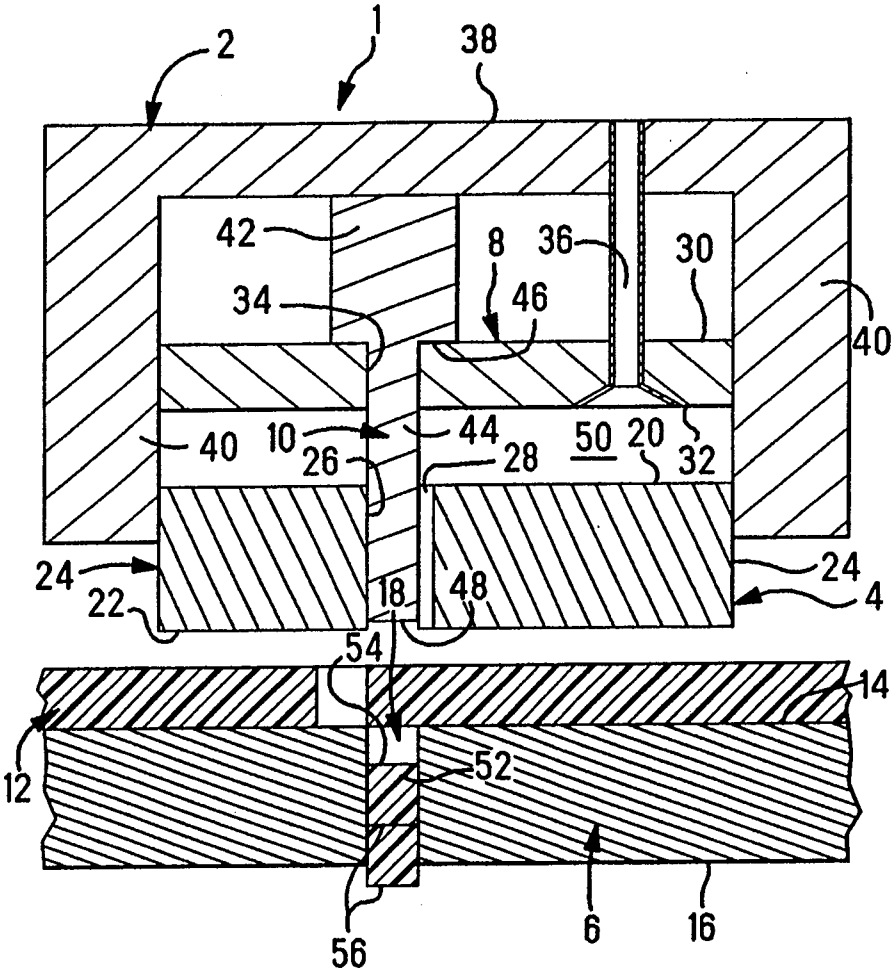
FIG. 8 is a cross sectional view of the punch apparatus with a stripper plate of the apparatus retracted from the strip of material, thereby allowing the advancement of the material.

As shown in FIG. 8, with the punch 10 completely retracted such that the bottom surface 48 thereof is provided above the material 10, the entire upper portion of the assembly is retracted, including the stripper plate 4. Also as is shown in FIG. 7, the slug 52 is retained in the slug receiving opening 18, as previously described. This allows the material 10 to be moved to the next position with no damage occurring. As a slug is maintained in the slug receiving opening, the tooling and material will not be deformed and will function as designed.

The movement of the die 10 as described is generated by using a toggle mechanism, which is well known in the industry. By displacing the center of a crank, single or double insertion of the punch can be readily accomplished.

By properly removing the slug 52, the stamping process is enhanced. The material is not damaged by the reintroduction of the slugs 52 therein as the material is advanced. The life of the punch is also enhanced, as the punch will wear more evenly.

The particular configuration for providing gas between the punch and the slug can be accomplished in a variety of different ways. The drawings and description represent one such embodiment, however changes in construction will occur to those skilled in the art and various apparently different modifications an embodiments may be made without departing from the scope of the invention. The matter set forth in the foregoing description and accompanying drawings is offered by way of illustration only. It is therefore intended that the foregoing description be regarded as illustrative rather than limiting.

I claim:

1. A method for stamping a strip of material, the stamping machine having a punch which moves through a first stroke and a second stroke and a slug receiving opening, the method comprising the steps of:

moving the punch, during the first stroke, into engagement with the strip of material;

punching a slug from the strip of material to form an opening therein;

moving the punch, during the second stroke, through the opening in the strip of material; and the punch forcing a volume of gas ahead of the punch, the volume of gas cooperating with the slug to force the slug into the slug receiving opening without said punch contacting said slug during said second stroke.

2. A method for stamping as recited in claim 1 wherein as the punch engages the strip of material during the first stroke, a vacuum is formed between a surface of the punch and the slug.

3. A method for stamping as recited in claim 2 wherein as the punch is retracted, during the first stroke, toward its initial position, the vacuum between the surface of the punch and the slug causes the slug to retract into the strip of material until the slug is frictionally engaged by a wall of the opening in the strip of material, the frictional force being sufficient to overcome the vacuum.

4. A method for stamping as recited in claim 3 wherein with the slug trapped in the opening of the strip of material, gas is provided between the surface of the punch and the slug.

5. A method for stamping as recited in claim 4 wherein the gas is air.

6. A method for stamping as recited in claim 4 wherein the gas is provided between the surface of the punch and the slug by a gas plenum which is positioned proximate the punch.

7. A method for stamping as recited in claim 6 wherein the volume of gas provided in the gas plenum is varied as the punch moves through the first and second strokes.

8. A method for stamping as recited in claim 7 wherein the gas exerts a force on a stripper plate, the force being sufficient to maintain the stripper plate in position relative to the strip of material.

9. A method for stamping as recited in claim 6 wherein the gas is moved from the gas plenum to between the surface of the punch and the slug by means of a channel which is positioned adjacent to the punch.

10. A method for stamping as recited in claim 9 wherein the gas is forced from the gas plenum to between the surface of the punch and the slug as the punch is moved through the second stroke.

11. A method for stamping as recited in claim 10 wherein the surface of the punch is moved beyond the channel thereby trapping the gas between the surface of the punch and the slug, whereby as the punch continues its movement during the second stroke, the gas remains between the surface of the punch and the slug to prevent a vacuum from forming therebetween, the movement of the punch is continued until the surface of the punch is moved beyond the strip of material and the slug is positioned in the slug receiving opening.

12. A method of stamping a slug from a strip of material comprising the steps of:

moving a punch through a first stroke, including;

punching the slug from the strip of material, moving a bottom of the punch beyond the strip of material, causing the slug to be moved beyond the strip of material, retracting the punch to proximate its initial position, causing the slug to partially retract into the strip of material, moving the punch through a second stroke, including:

trapping gas between a bottom surface of the punch and the slug, moving the bottom surface of the punch beyond the strip of material, causing the slug to be moved beyond the strip of material without said punch contacting said slug during said second stroke, retracting the punch to its initial position while the slug remains in position beyond the strip of material.

13. A method of stamping as recited in claim 12 wherein with the slug in the partially retracted position in the strip of material, gas is provided between the bottom surface of the punch and the slug.

14. A method of stamping as recited in claim 13 wherein the gas is air.

15. A method of stamping as recited in claim 13 wherein the gas is moved from a gas plenum to between the surface of the punch and the slug by means of a channel which is positioned adjacent to the punch.

16. A method of stamping as recited in claim 15 wherein the volume of gas provided in the gas plenum is varied as the punch moves through the first and second strokes.

17. A method of stamping as recited in claim 16 wherein the gas exerts a force on a stripper plate, the force being sufficient to maintain the stripper plate in position relative to the strip of material.

18. A method for stamping as recited in claim 17 wherein the bottom surface of the punch is moved, during the second stroke, beyond the channel thereby trapping the gas between the bottom surface of the punch and the slug, whereby as the punch continues its movement during the second stroke, the gas remains between the bottom surface of the punch and the slug to prevent a vacuum from forming therebetween, the movement of the punch is continued until the bottom surface of the punch is moved beyond the strip of material and the slug is positioned in a slug receiving opening.

* * * * *

UNITED STATES PATENT AND TRADEMARK OFFICE

CERTIFICATE OF CORRECTION

PATENT NO. : 5,448,933
DATED : September 12, 1995
INVENTOR(S) : Dimitry G. Grabbe It is certified that error appears in the above-indentified patent and that said Letters Patent is hereby corrected as shown below:

On title page,

Item 75: The inventor's name should read --Dimitry G. Grabbe--.

Item 56: The attorney's name should read --Bruce J. Wolstoncroft--.

Signed and Sealed this

Thirtieth Day of January, 1996

Bruce Lehman

*Attest:*

BRUCE LEHMAN

*Attesting Officer*

*Commissioner of Patents and Trademarks*